US011076452B2

(12) United States Patent
Bursztein

(10) Patent No.: US 11,076,452 B2
(45) Date of Patent: Jul. 27, 2021

(54) HEATING MODULE

(71) Applicant: FORMASTER S.A., Kielce (PL)

(72) Inventor: Slawomir Bursztein, Kielce (PL)

(73) Assignee: FORMASTER S.A., Kielce (PL)

( * ) Notice: Subject to any disclaimer, the term of this patent is extended or adjusted under 35 U.S.C. 154(b) by 593 days.

(21) Appl. No.: 15/505,701

(22) PCT Filed: Aug. 21, 2015

(86) PCT No.: PCT/IB2015/056339
§ 371 (c)(1),
(2) Date: Feb. 22, 2017

(87) PCT Pub. No.: WO2016/027255
PCT Pub. Date: Feb. 25, 2016

(65) Prior Publication Data

US 2017/0238366 A1 Aug. 17, 2017

(30) Foreign Application Priority Data

Aug. 22, 2014 (PL) ..... 409235

(51) Int. Cl.
*H05B 3/06* (2006.01)
*H05B 3/24* (2006.01)

(52) U.S. Cl.
CPC ..... *H05B 3/06* (2013.01); *H05B 3/24* (2013.01); *H05B 2203/024* (2013.01)

(58) Field of Classification Search
CPC ..... H05B 3/06; H05B 3/24; H05B 2203/022; H05B 2203/023; H05B 2203/024
USPC ..... 219/532, 520, 536
See application file for complete search history.

(56) References Cited

U.S. PATENT DOCUMENTS 4,058,789 A * 11/1977 Bavisotto ..... H01R 4/625 338/322
5,526,462 A * 6/1996 Kondo ..... F01N 3/2026 392/485
2009/0236327 A1* 9/2009 Everly ..... F24D 13/02 219/260

(Continued)

FOREIGN PATENT DOCUMENTS

DE 20103867 U1 6/2001
EP 1528837 A1 5/2005

(Continued)

*Primary Examiner* — Tu B Hoang
*Assistant Examiner* — Alba T Rosario-Aponte
(74) *Attorney, Agent, or Firm* — Browdy and Neimark, PLLC

(57) ABSTRACT

The invention relates to a heating module comprising a resistive heating element placed in a frame. The heating module constitutes a ready heating subassembly for heating a gas or a liquid, in particular for heating the air. The heating element is mounted to the frame by means of the at least two contacts arranged at opposite side walls of the heating element, wherein each contact comprises at least two brackets releasably coupled to a side wall, and at least one resilient element connected to the brackets and to at least one catch releasably coupled to the frame, wherein each resilient element, arranged in contact with a side wall of the heat ing element, is tensioned and exerts an expanding force acting on the connection of the contact with the frame and the heating element.

11 Claims, 4 Drawing Sheets

(56) References Cited

U.S. PATENT DOCUMENTS

| | | | | |
|---|---|---|---|---|
| 2011/0068099 | A1 | 3/2011 | Bohlender et al. | |
| 2012/0076698 | A1 | 3/2012 | Ishihara | |
| 2013/0161306 | A1 * | 6/2013 | Bohlender ..... | H05B 3/02<br>219/202 |

FOREIGN PATENT DOCUMENTS

| | | | | |
|---|---|---|---|---|
| PL | 398907 | A1 | 10/2013 | |
| WO | 2013157971 | A1 | 10/2013 | |
| WO | WO-2013157971 | A1 * | 10/2013 ..... | H05B 3/12 |

* cited by examiner

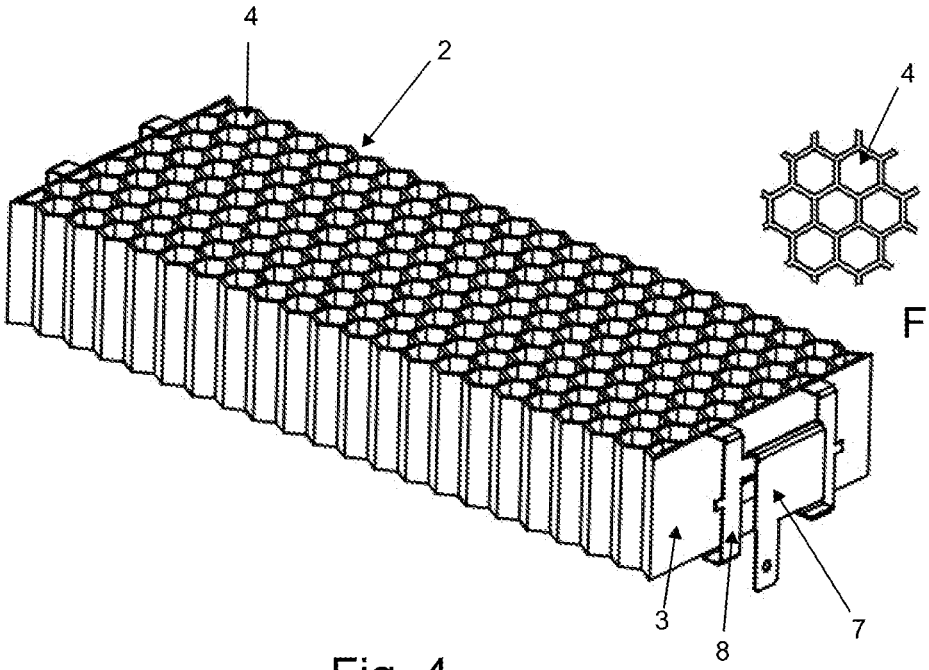
Fig. 4
Fig.5
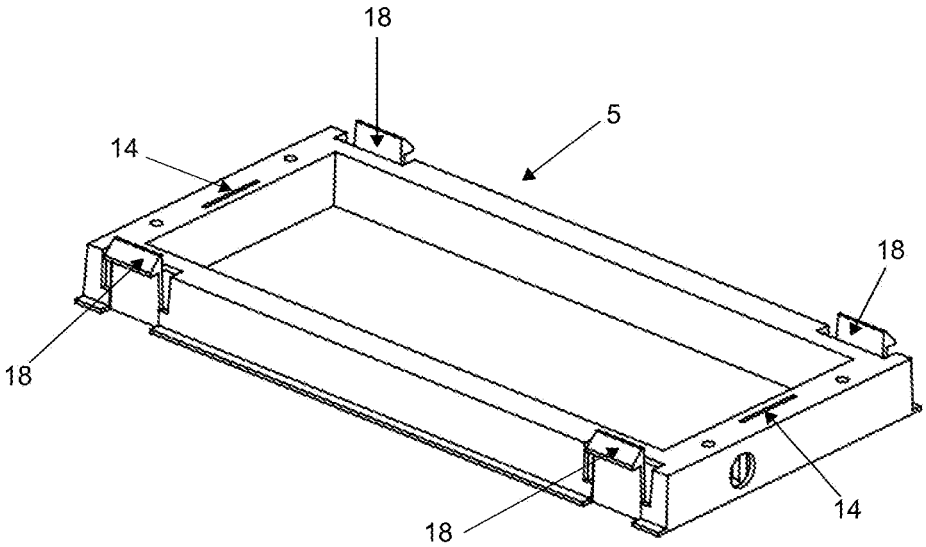
Fig. 6

HEATING MODULE

The object of the invention is a heating module comprising a resistive heating element placed in a frame. The heating module provides a ready heating subassembly for heating a gas or a liquid, in particular for heating the air. The heating module can be used in different types of heating devices, e.g. in radiators, air curtains, heaters.

Each heating module is a unitary subassembly ready for use in a heating device. In order to obtain a heating part of a specified size and power, several identical modules are used. As a result of using such a solution, in case of failure of a given subassembly, it is possible to quickly and easily replace the defective module without having to replace the entire heating part.

Polish patent application PL 398907 discloses a resistive heating element having through holes, which is provided with terminals for supplying electric current. The terminals have pressing leafs which mount the heating element. The heating element, together with the terminals, is mounted directly in the device or to the frame. Due to their specific structure and location, the pressing leafs immobilise the heating element in only one direction. Such a mounting can result in an uncontrolled sliding of the heating element, as a result of which the heating element may come into a contact with parts other than electric contacts, which can lead to heating up, and in consequence failure of these elements. Furthermore, the heating element offset with respect to its optimum position, which is generally the position centred relative to the frame, does not operate in an optimal manner because the flow of air around it is uneven.

In order to solve the above-mentioned problems, a heating module according to the invention has been developed.

The aim of the invention is to develop a heating module in which a heating element is more stably and effectively mounted than in known modules of similar type.

Furthermore, the aim of the invention is to achieve a better insulation of the heating element from its frame.

The aim of the invention is also to develop a heating module in which the air flow is more even than in known heating modules.

the heating module according to the invention comprises a resistance heating element placed in an electrically non-conductive frame and at least two contacts arranged between the frame and the heating element, the contacts supplying electric current to the heating element the side walls of which are directed towards the frame. The heating module is characterised in that the heating element is mounted to the frame by means of the at least two contacts arranged at opposite side walls of the heating element, wherein each contact comprises at least two brackets releasably coupled to a side wall, and at least one resilient element which is connected to the brackets and to at least one catch releasably coupled to the frame, wherein the resilient element, placed in contact with a side wall of the heating element is tensioned and exerts an expanding force acting on the connection of the contact with the frame and the heating element.

Preferably, the contact consists of two brackets and a resilient element arranged between the brackets.

Preferably, the contact consists of two brackets and two resilient elements, wherein the two brackets are arranged next to each other between the resilient elements.

Preferably, the contact consists of two brackets and three resilient elements, wherein the brackets and the resilient elements are arranged alternately in the contact.

Preferably, an air gap exists between the frame and the heating element of the heating module.

Preferably, the side walls of the heating element, at which the contacts are arranged, are flat.

Preferably, the heating element is in the form of a rectangular prism having a honeycomb structure and comprises a plurality of elongated through channels parallel to the side walls.

Preferably, the brackets are coupled to the side wall by means of their hook-like bent ends placed in opposite outlets of the channels adjacent to the side wall.

Preferably, the resilient element is constituted by a resiliently bent leaf.

Preferably, the resilient element is constituted by a rigid element connected to a spring.

Preferably, the side walls of the heating element are covered with an electrically conductive coating. For example, it is a copper coating.

The resilient contact, used in the heating module, in combination with the frame, provides mounting of the heating element that compensates vibrations into which it can be set during transport or use. Such a structure immobilises the heating element in relation to the frame in all directions, which ensures uniform and resilient maintaining of the heating element in the frame. The expanding force acting on the connection of the contact with the frame and the heating element allows maintaining this element in a proper position.

The heating element is made of a material which is brittle, which makes it vulnerable to cracking. Thanks to the structure of the heating module according to the invention, in particular to the expanding force acting on the heating element, in case the heating element cracks, the element remains in the essentially unchanged position in relation to the optimal position. Consequently, there is no possibility for a part of the heating element to fall out or even move. As a result, the defective heating element will not approach other parts of the device, and therefore any risk of damaging these parts by the cracked heating element can be excluded.

The innovative mounting of the heating element in the frame of the module according to the invention is more stable and reliable than known solutions of this type, and at the same time it allows maintaining a gap between the frame and the heating element, which ensures a uniform air flow.

DESCRIPTION OF FIGURES

Embodiments of the invention are illustrated in the drawing, in which:

FIG. 4 shows a perspective view of the heating element with the contact mounted thereto;

FIG. 5 shows an enlarged top view of a portion of the heating element;

FIG. 6 shows a perspective view of the frame of the heating element;

FIG. 1 shows a heating module 1 comprising a frame 5 and a resistive heating element 2 placed in the frame 5. The heating element is a resistance heating element, i.e. it heats up due to the flow of electric current through it. The resistance element is made of any well-known resistive material. Typically, such a material comprises a ceramic component and a conductive component, e.g. kaolin (china clay) and graphite. In the illustrated embodiment, the heating element 2 has a honeycomb structure with a number of parallel through channels 4 (shown enlarged in FIG. 5), and side walls 3, 3' of the heating element 2 are directed towards the frame 5. Thanks to the channels 4, the heating surface of the heating element 2 which contacts the heated air is very large. Generally, the cross-section of the through channels 4 may be of any shape, e.g. it may be a square, a rectangle, a hexagon. The honeycomb structure, with hexagonal-shaped channels, is particularly advantageous because it provides an even flow of current in the entire heating element, and thus a uniform heating up thereof.

The frame 5 of the heating module 1 is made of a material which does not conduct electric current. It is desirable that the frame 5 is as thin as possible, so that with a given surface of the heating module, a correspondingly greater heating element can be used. The frame 5 is made of a material which is an electrical insulator, and despite that, it heats up during use of the heating module. The heating medium of the frame 5 is the heated air surrounding it. The frame 5 is made of a plastic material resistant to high temperatures so that its characteristics do not change under the influence of heat. The plastic may be e.g. a polyamide with glass fibre with a flame retardant additive. The heated frame may reach a temperature e.g. above 200° C.

During use, the heating element 2 heats up to a suitable temperature, e.g., approx. 80-200° C. Typically, in the heating device, apart from the heating element 2, standard safety elements are used, e.g. a temperature-adjusting thermostat, a thermal fuse or an emergency stop switch which will be activated in the event of overturning of the device.

Figure 1:
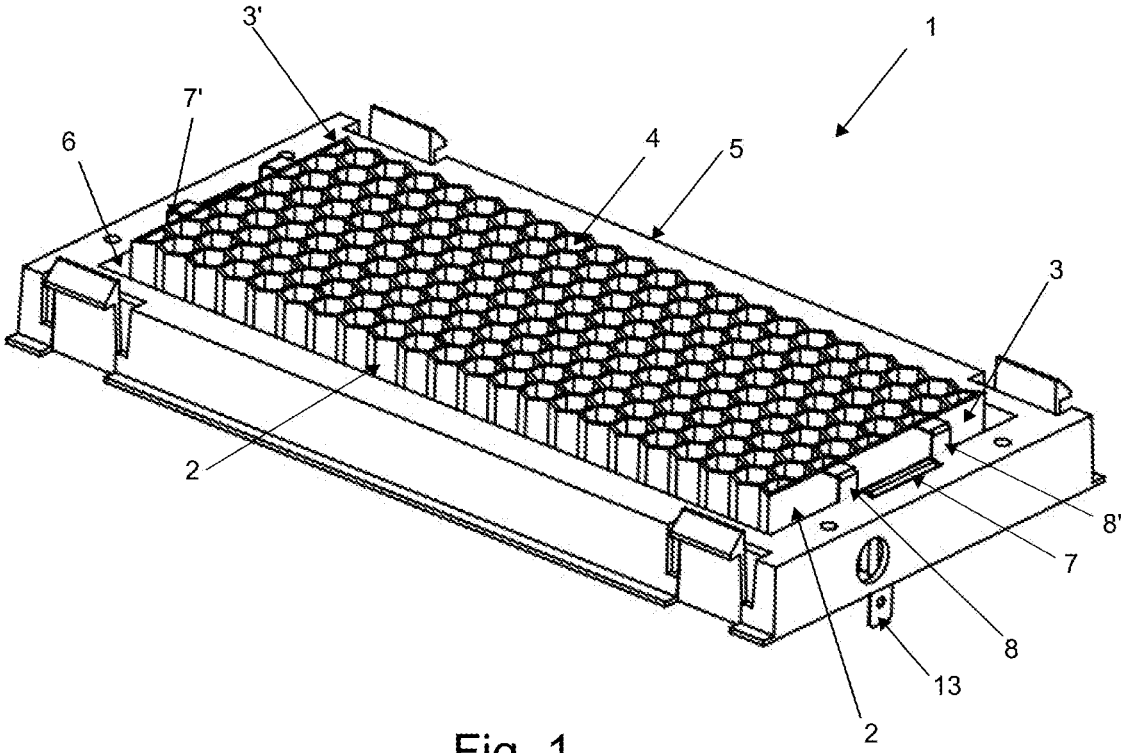
FIG. 1 shows a perspective view of the heating module.

As can be seen in FIG. 1, the heating element 2 is mounted to a frame 5 by means of contacts 7, 7', placed on respective opposite side walls 3, 3' of the heating element 2. Preferably, the contacts 7 and 7' have the same structure on both opposite walls 3, 3'. Each contact 7, 7' must ensure a good flow of the current to the heating element 2, therefore it is made of an electrically conductive material, preferably it is silver-plated. In a preferred embodiment, there is an additional element (not shown) at the ends of the heating element 2, providing an even distribution of the electric current across the entire width of the heating element. Such a distributing element may be, for example, a copper layer or a copper strip sunk at the ends of the heating element.

The contacts 7, 7', thanks to their structure, provide a resilient connection of the heating element 2 with the frame 5, and being made of an electrically conductive material, they supply the electric current to the heating element 2.

Figure 2A:
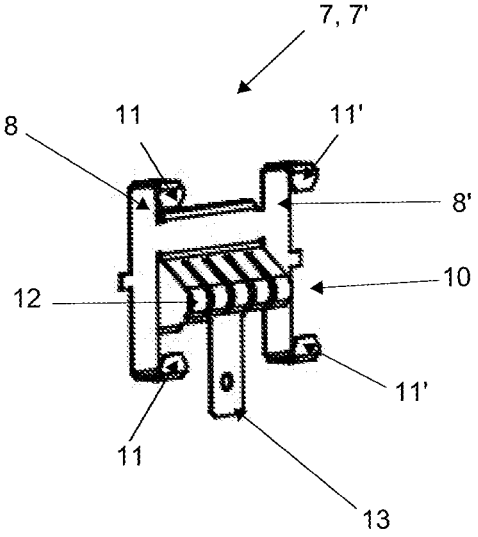
FIG. 2*a* shows a general view of the contact used in the heating module according to the fist embodiment.
Figure 2B:
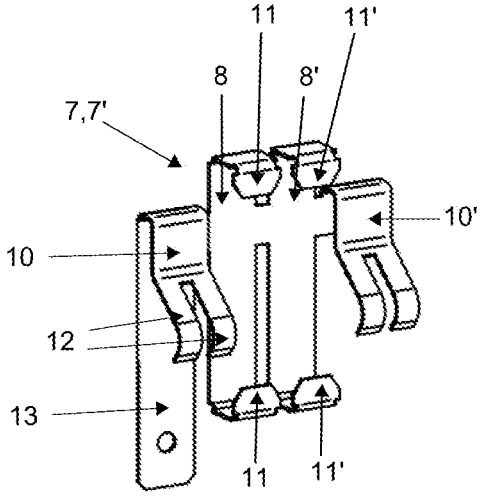
FIG. 2*b* shows a perspective view of the contact used in the heating module according to the second embodiment.

FIGS. 2*a*-2*d* show various embodiments of the contact 7, 7'. As can be seen, each contact 7, 7' comprises at least two brackets 8, 8' and at least one resilient element 10. The number of the brackets 8, 8' and the resilient elements 10 is adjusted to the current intensity used during operation of the heating element. The contact 7, 7' should not consist of too many components in order not to suppress the flow of air around the heating element. The contacts 7, 7' are arranged on opposite sides of the heating element 2 between the heating element 2 and the frame 5. FIG. 2*a* shows the structure of the contact 7, 7' according to the first embodiment. In the embodiment shown in FIG. 2*a*, the contact 7, 7' comprises two brackets 8, 8', one resilient element 10 placed between the brackets 8, 8' and a catch 13 for mounting the contact 7 to the frame 8. In this embodiment, the resilient element 10 is in the form of bent leafs 12. In this case, the pressing force results from the resilience of the metal sheet is used. The brackets 8, 8' of the contact 7, 7' have hook-like bent ends 11, 11'. The ends 11, 11' of the brackets 8, 8', bent towards the interior of the heating element 2, securely mount the heating element 2 in a predetermined position. In this embodiment, standard shaped through holes are used as a part of the heating element 2, to which the contact 7 is mounted, so there is no need to form any other mounting parts in the structure of the heating element. However, it is possible to foresee, special formations in the heating element for mounting the contact. The contact 7, 7' shown in FIG. 2*b* comprises two brackets 8, 8' and two resilient elements 10, 10'. The brackets 8, 8', having hook-like bent ends 11, 11', are adjacent to each other, whereas the resilient elements 10, 10' are on opposite sides of the brackets 8, 8'. The catch 13 may be connected to any resilient element 10 of the contact 7, 7'.

Figure 2C:
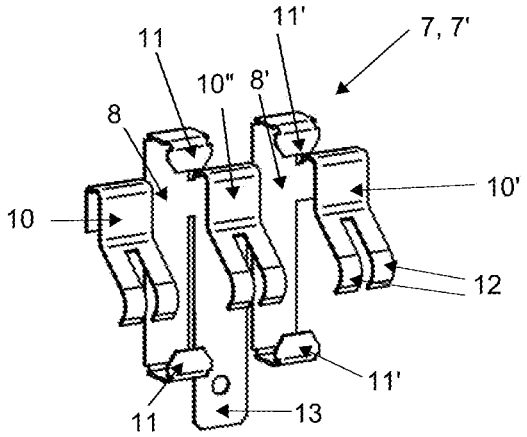
FIG. 2*c* shows a perspective view of the contact used in the heating module according to the third embodiment.

The contact 7, 7' shown in FIG. 2*c* comprises two brackets 8, 8', having hook-like bent ends 11, 11' and three resilient elements 10, 10', 10". The brackets 8, 8' and the resilient elements 10, 10', 10" are arranged in the contact 7, 7'alternately. The catch 13 is connected to the central resilient element 10' which is arranged between the brackets 8, 8'.

Figure 2D:
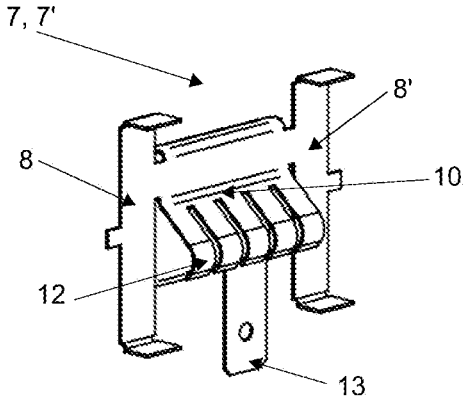
FIG. 2*d* shows a perspective view of the contact used in the heating module according to the fourth embodiment.

In FIG. 2*d*, the contact 7, 7' according to the fourth embodiment is shown. In this embodiment, the brackets 8, 8' of the contact 7 have unbent ends.

Figure 3:
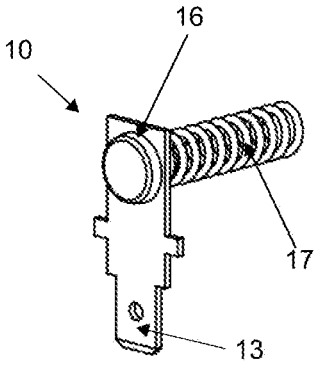
FIG. 3 shows a perspective view of the resilient element according to the fourth embodiment.

In FIG. 3, an alternative embodiment of the resilient element 10 of the contact 7, 7' is shown. The resilient element comprises a rigid element 16 in the form of, e.g., a bimetallic contact connected to a spring 17. The catch 13 is shown in a flat configuration, prior to engagement with the frame 5.

In FIG. 4, the contact 7 according to the first embodiment, mounted to the side wall 3 of the heating element 2 is shown. The brackets 8, 8' extend over the entire height of the side wall 3' of the heating element 2, and the ends 11, 11' of the brackets 8, 8' are bent towards the interior of the channels 4 of the heating element 2.

FIG. 5 shows an enlarged top view of a portion of the heating element, showing a cross-section of the channels 4 in the shape of a honeycomb.

In FIG. 6, the frame before placing the heating element 2 therein is shown. In the opposite side walls of the frame 5, through slots 14 for mounting the contacts 7, 7' can be seen. The element for mounting the contacts in the frame may consist, e.g., of a recess (not shown) or several slots (not shown). On the edges of the frame 5, there are also mounting elements 18, by means of which the frame 5 is mounted in the heating device. In order to assemble the heating module 1 according to the invention, the heating element 2 shown in FIG. 4, together with the contacts 7, 7' mounted thereto, is mounted in the frame so that the catches 13 of the contacts are slid from the top into the slots 14 (the expression "from the top" refers to the configuration shown in FIGS. 1, 4 and 6). Then, the catches 13 of the contacts 7, 7', placed in this way in the slots 14, protruding on the other side of the slots 14, are blocked in the frame 5, e.g. by bending them.

Figure 7:
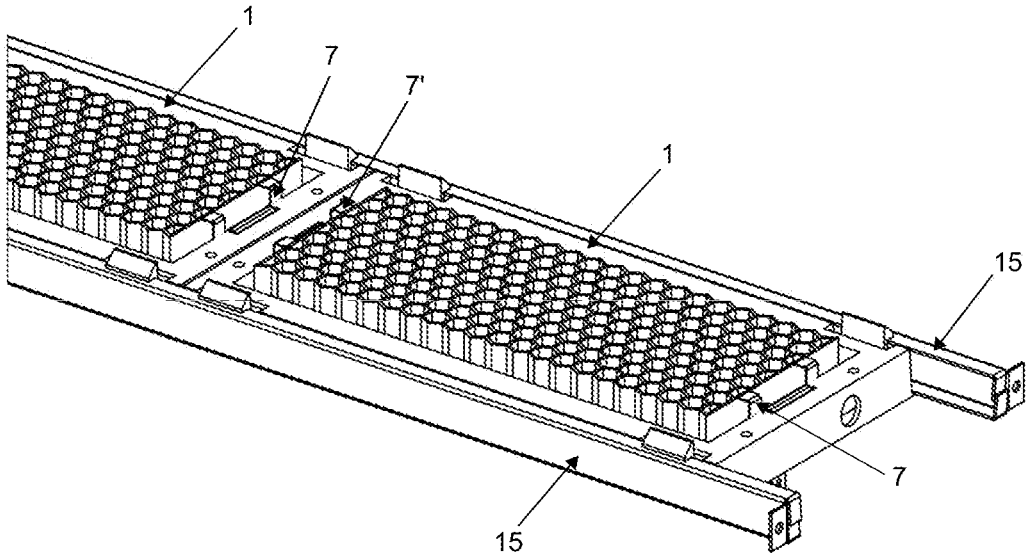
FIG. 7 shows a perspective view of two connected heating modules.

In FIG. 7, two heating modules 1 are shown, connected to each other in such an arrangement in which they are present in the heating device. In the illustrated embodiment, the heating modules 1 are placed between guides 15 which constitute a mounting structure for the heating modules 1. The heating modules 1 are arranged next to each other in such a manner that the contacts 7, 7' are directed towards each other. The contacts 7 and 7' of the adjacent heating modules are connected to each other, and electric current is supplied to the contacts of the heating modules located at the extremes of the heating device. The heating modules 1 are therefore connected in series with each other. The electric current is supplied to the contacts 7, 7' of the heating elements located at the extremes of the heating device.

The heating modules may be mounted on the guides or to elements of the heating devices.

The heating element 2, mounted on the frame 5, constitutes a ready structural subassembly for use in the devices having an air heating function. A frame having a higher number of heating elements 2 arranged one next to the other may also be used. Such frames with a plurality of heating elements 2 may also be connected to one another to produce larger heating assemblies.

The invention claimed is:

1. A heating module comprising:

an electrically non-conductive frame comprising a frame body, wherein the frame body comprises side walls defining an opening within the frame, and at least two through slots each one arranged in a corresponding side wall of the frame body, each of, the at least two through slots being defined as a pass-through slit having a length, and a width smaller than the length, the length of the slit extending parallel to the corresponding side wall of the frame body, a resistance heating element comprising a top side, a bottom side, and side walls arranged between the top side and the bottom side, wherein the resistance heating element is arranged in the opening within the frame, and at least two contacts, each of said at least two contacts configured to be releasably mounted in one of the at least two through slots in the frame and releasably connected to the heating element, the contacts supplying electric current to the heating element, wherein the at least two contacts are arranged at opposite walls of the side walls of the heating element, wherein each contact of the at least two contacts comprises:

at least two brackets releasably and directly coupled to the heating element, wherein each bracket of the at least two brackets comprises two ends arranged on the top side and the bottom side, respectively, of said heating element to retain the heating element in position in the frame, at least one resilient element connected to the brackets, and at least one catch directly connected to the at least one resilient element, the at least one catch being releasably coupled to the frame by being releasably inserted into one of the at least two through slots of the corresponding side wall of the frame, the at least one catch extending entirely through one of the at least two through slots in the frame, wherein each resilient element is tensioned and arranged in contact with a respective one of the opposite side walls of the heating element and exerts an expanding force acting on each of the at least two contacts, and wherein the at least one resilient element and the at least two brackets of each one of the at least two contacts connect with the frame and the heating element to maintain resiliently the heating element in a position in the opening within the frame.

2. The heating module according to claim 1, wherein the contact consists of two brackets and a resilient element arranged between the brackets.

3. The heating module according to claim 1, wherein the contact consists of two brackets and two resilient elements, wherein the two brackets are arranged next to each other between the resilient elements.

4. The heating module according to claim 1, wherein the contact consists of two brackets and three resilient elements, wherein the brackets and the resilient elements are arranged alternately in the contact.

5. The heating module according to claim 1, wherein an air gap exists between the frame and the heating element.

6. The heating module according to claim 1, wherein the side walls of the heating element, at which the contacts are arranged, are flat.

7. The heating module according to claim 1, wherein the heating element is in the form of a rectangular prism having a honeycomb structure and comprises a plurality of elongated through channels parallel to the side walls.

8. The heating module according to claim 7, wherein the ends of the brackets comprise further hook-like bents, wherein the hook-like bents are placed in opposite outlets of the channels on the top side and a bottom side of the heating element adjacent to the side wall of said heating element.

9. The heating module according to claim 1, wherein the resilient element is constituted by at least one resiliently bent leaf.

10. The heating module according to claim 1, wherein the resilient element is constituted by a rigid element connected to a spring.

11. The heating module according to claim 1, wherein the side walls of the heating element are covered with an electrically conductive coating.

* * * * *